US006627042B2

(12) United States Patent
Holik

(10) Patent No.: US 6,627,042 B2
(45) Date of Patent: Sep. 30, 2003

(54) PROCESS FOR THE FORMATION OF A MULTI-PLY AND/OR MULTILAYER FIBER WEB

(75) Inventor: Herbert Holik, Ravensburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/848,076

(22) Filed: May 3, 2001

(65) Prior Publication Data

US 2001/0045265 A1 Nov. 29, 2001

(30) Foreign Application Priority Data

May 5, 2000 (DE) ..... 100 21 979

(51) Int. Cl.[7] ..... D21F 1/04; D21H 17/64

(52) U.S. Cl. ..... 162/123; 162/124; 162/125; 162/128; 162/158; 162/181.1

(58) Field of Search ..... 162/123, 124, 162/125, 128, 158, 181.1, 181.2, 181.4, 182, 183, 184, 185

(56) References Cited

U.S. PATENT DOCUMENTS

| | | | | |
|---|---|---|---|---|
| 4,781,793 A | | 11/1988 | Halme | 162/55 |
| 5,223,090 A | | 6/1993 | Klungness et al. | 162/9 |
| 5,401,363 A | | 3/1995 | Begemann et al. | 162/164.6 |
| 5,665,205 A | * | 9/1997 | Srivatsa et al. | 162/181.4 |
| 5,731,080 A | | 3/1998 | Cousin et al. | 428/372 |
| 6,210,535 B1 | * | 4/2001 | Huovila et al. | 162/322 |
| 6,251,223 B1 | | 6/2001 | Kessler et al. | 162/125 |
| 6,270,624 B1 | * | 8/2001 | Huovila et al. | 162/127 |
| 2001/0037867 A1 | * | 11/2001 | Huovila et al. | 162/258 |

FOREIGN PATENT DOCUMENTS

| | | | |
|---|---|---|---|
| DE | 1 940 321 | 7/1970 | |
| DE | 4436317 A1 | 4/1996 | D21H/21/10 |
| GB | 2 265 916 A | 10/1993 | D21H/15/02 |
| WO | WO 99/49133 | 9/1999 | D21H/17/67 |

* cited by examiner

*Primary Examiner*—Dean T. Nguyen
(74) *Attorney, Agent, or Firm*—Taylor & Aust, P.C.

(57) ABSTRACT

In a process and a device for the formation of a multi-ply and/or multi-layer fiber material web, in particular of a paper or cardboard web, at least one of the two external plies and/or layers of the fiber material web is formed using fiber material, on whose wetted fiber surfaces, at least one additive has been at least partially deposited.

14 Claims, 2 Drawing Sheets

PROCESS FOR THE FORMATION OF A MULTI-PLY AND/OR MULTILAYER FIBER WEB

BACKGROUND OF THE INVENTION

1. Field of the Invention

The present invention relates to a process and device for the formation of a multi-ply and/or multi-layer fiber web, and more particularly to a process and device for the formation of a multi-ply and/or multi-layer paper or cardboard web.

2. Description of the Related Art

The conservative use of raw material resources, in particular for economic and ecological reasons, impacts paper production in the form of ever-lower area-specific weights of paper webs, as well as in the partial substitution of the pulp material with fillers. This constitutes a challenge not only for the paper producer, but also for the manufacturer of paper production machines. Paper quality and the productivity of the machines must not only be maintained in spite of these measures, but are supposed to be further improved. In this context, the so-called multi-ply technology is increasingly deployed, in which, in comparison to conventional multi-layer sheet formation, the web is built from individual layers with a very low area-specific weight. In this process, various suspension flows exiting from the headbox are simultaneously drained off in one and the same web-formation zone. Accordingly, various types of raw materials can be used to structure the web. If low cost raw materials are used, the quality is to be maintained. With the same type of raw material, the question of how to improve the quality becomes relevant. In all of this, stability, optical quality, and further processability of the end product play a critical role. For example, it may be desirable for graphic paper types, for economic reasons and reasons of printing technology, to have a higher filler content in the external layers and a lesser filler content in the middle layer. The higher filler content in the external layers produces paper that is better to print on and has improved opacity. Even when using multi-ply technology in combination with a multi-layer headbox and a high filler content in the partial suspension flows, which form the external layers, results are still unsatisfactory, the cause of which resides mainly in the low rate of filler retention. Accordingly, the suspension flows of each headbox, that form the external layers, require a much increased filler content. Due to the low retention rate, the filler load on the water strainer cycle is high. Due to the external layers being washed out as a result of the prevailing drainage conditions, only a limited enrichment of the external layers of the paper with ashes results.

It is the objective of the invention to develop an improved process and an improved device of the aforementioned type, in which the aforementioned disadvantages are eliminated, making it possible to increase the enrichment of the external layers of the pulp material web with fillers in an economic manner and beyond the limits that have existed so far.

SUMMARY OF THE INVENTION

The present invention provides a process, and a device in which at least one of the two external layers and/or plies of the pulp material web is produced using pulp material onto the wetted fiber surfaces of which, at least partially, an additive, preferably a filler, has been deposited, or the fibers of which have been loaded with at least one additive, particularly a filler.

In this context, the concept of "wetted fiber surfaces" may include all wetted surfaces of the individual fibers. This covers in particular also the cases where the fibers are loaded with an additive or filler, both on their external sides and in their interior spaces (lumen).

Due to this special form of loading, the retention rate in the external layers is drastically increased, which is due to the circumstance that the additives, here in particular fillers, are bonded tightly to the exterior fiber surface and to some extent also to the interior fiber surface. The association between the fillers and the fiber surface is relatively strong. The result is a high filler retention rate in the external layers or plies of the paper with a low load on the water strainer and a relatively low suspension filler concentration in the external layers or plies in the headbox. If required, the filler content in the layers or plies can even be further increased in conventional ways. The invention cannot only be used when forming a fiber web from pulp material suspensions layered in the direction of the z-axis, i.e., in thickness direction, with different additive or filler contents, but also when forming a fiber web from pulp material suspensions layered in the direction of the z-axis with identical filler contents. In addition, the invention cannot only be used in the preferred multi-ply sheet formation, but also in conventional multi-ply sheet formation. It is essential that so-called "fiber loading" be used for the materials in the external layers, which has been described in U.S. Pat. No. 5,223,090. In the process that is described hereby, the entire material is treated accordingly. Also, the procedure of loading additive or filler into an external or internal ply or layer may follow the process as described in U.S. Pat. No. 5,223,090, the content thereof is incorporated into this patent application by reference.

In the process, an additive is deposited on the external surfaces of the hollow fibers, and it is also preferably deposited in the interior hollow areas and in the walls of the hollow fibers. The additive is thus deposited on the "wetted" fiber surface, i.e., both on the exterior surface and on the interior hollow spaces, as well as into the walls of the hollow fibers.

In one embodiment of the invention, there is formed a fiber material web that features at least two and in particular three plies or layers, both or only one of the external plies or layers of the pulp material web are produced using pulp material, on the wetted fiber surfaces of which, at least partially, at least one additive has been deposited. Accordingly, both plies or layers or only one of the external plies or layers of the fiber material web can be produced using fiber material, the hollow fibers of which have been loaded at least partially with at least one additive, which preferably has, again, been deposited both on the external surfaces of the fibers and in their interior spaces.

The additive may preferably include at least one filler.

For the formation of at least a two-ply or two-layer and in particular of an at least three-ply or three-layer fiber material web, at least one of the two external plies or layers is produced with a higher additive or filler content than at least one intermediate ply or layer.

In one embodiment of the invention, calcium carbonate is deposited, as an additive or filler, on the wetted fiber surfaces.

A preferred embodiment of the invention is characterized by the deposition of calcium carbonate, a substance containing calcium oxide (CaO) and/or calcium hydroxide ($Ca(OH)_2$) to the wet disintegrated fiber material in such a manner that at least part of it associates with the water that is contained in the fiber material. The fiber material treated in this manner is loaded with carbon monoxide in such a way that the deposition of calcium carbonate on the wetted fiber surfaces occurs as the result of a corresponding chemical reaction. This does not mean that by adding CaO and/or $Ca(OH)_2$, water of the fiber material suspension must be chemically transformed.

In this process, the substance containing calcium oxide and/or calcium hydroxide will be added at a rate of approximately 0.1% to 50% by weight with respect to the dry weight of the pulp material in question. The pulp material is preferably loaded with carbon monoxide in a closed container that is appropriately pressurized with carbon dioxide gas.

It is advantageous if the pulp material is loaded with carbon dioxide during a mixing process, in which it is exposed to increased shear forces. In this process, the mixing procedure should be performed with a shearing effect that is at least so high as to result in an energy input of at least approx. 10 to 50 W-hr per kg of fiber on the basis of dry weight.

According to this invention it is also possible to produce only one of the two plies or layers of the fiber material web, in order to form a two-ply or two-layer fiber material web. This is accomplished by using pulp material, on the wetted fiber surfaces of which an additive has at least partially been deposited in the manner described above.

Regarding pulp material, it is advantageous if wood pulp dissolved in a pulper or dissolved waste paper with additives are used, or "never dried pulp" is used. Both applications result in advantages, with regard to process technology (including short processing times), control technology (including good controllability), and costs (including cost reduction potentials), depending on the application.

The invention is also characterized by one material suspension feed that is provisioned for the formation of an external ply and/or external layer of the pulp web, which can be loaded with pulp material, on whose fiber surfaces at least one additive has been at least partially deposited.

In one embodiment of the invention, the device includes at least one multi-layer headbox, which, (in order to form two plies, or in order to form two external plies, or in order to form two external plies and at least one internal ply located between them) features at least two material suspension feeds in which only one or two of the material suspension feeds, serve to form the two external plies, which are loaded with pulp material, and on whose fiber surfaces at least one additive has been at least partially deposited.

A further embodiment of the invention provides for the formation of two layers, or two external layers and at least one internal layer that is located between them. The invention includes at least two headboxes, which each feature at least one material suspension feed, and in which at least one headbox is instrumental in the formation of the two external layers, and can be loaded with pulp material, in which the fiber surfaces have an additive which has been at least partially deposited.

The additive or filler, again, may be calcium carbonate.

Another embodiment of the invention provides a device which includes at least one multi-layer headbox, in order for form two plies, featuring two material suspension feeds, and in which only one of these two material suspension feeds is loaded with pulp material, on whose fiber surfaces an additive has been at least partially deposited, in the manner described above.

A further embodiment of the invention includes at least two headboxes, for the purpose of forming several layers, of which at least one is loaded with pulp material, on the wetted surfaces of the fibers therein at least one additive has at least partially been deposited, in the manner described before.

In addition, the material suspension may include wood pulp that has been dissolved in a pulper, or dissolved waste paper with additives, or "never dried pulp".

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates one preferred embodiment of the invention, in one form, and such exemplification is not to be construed as limiting the scope of the invention in any manner.

DETAILED DESCRIPTION OF THE INVENTION

Figure 1:
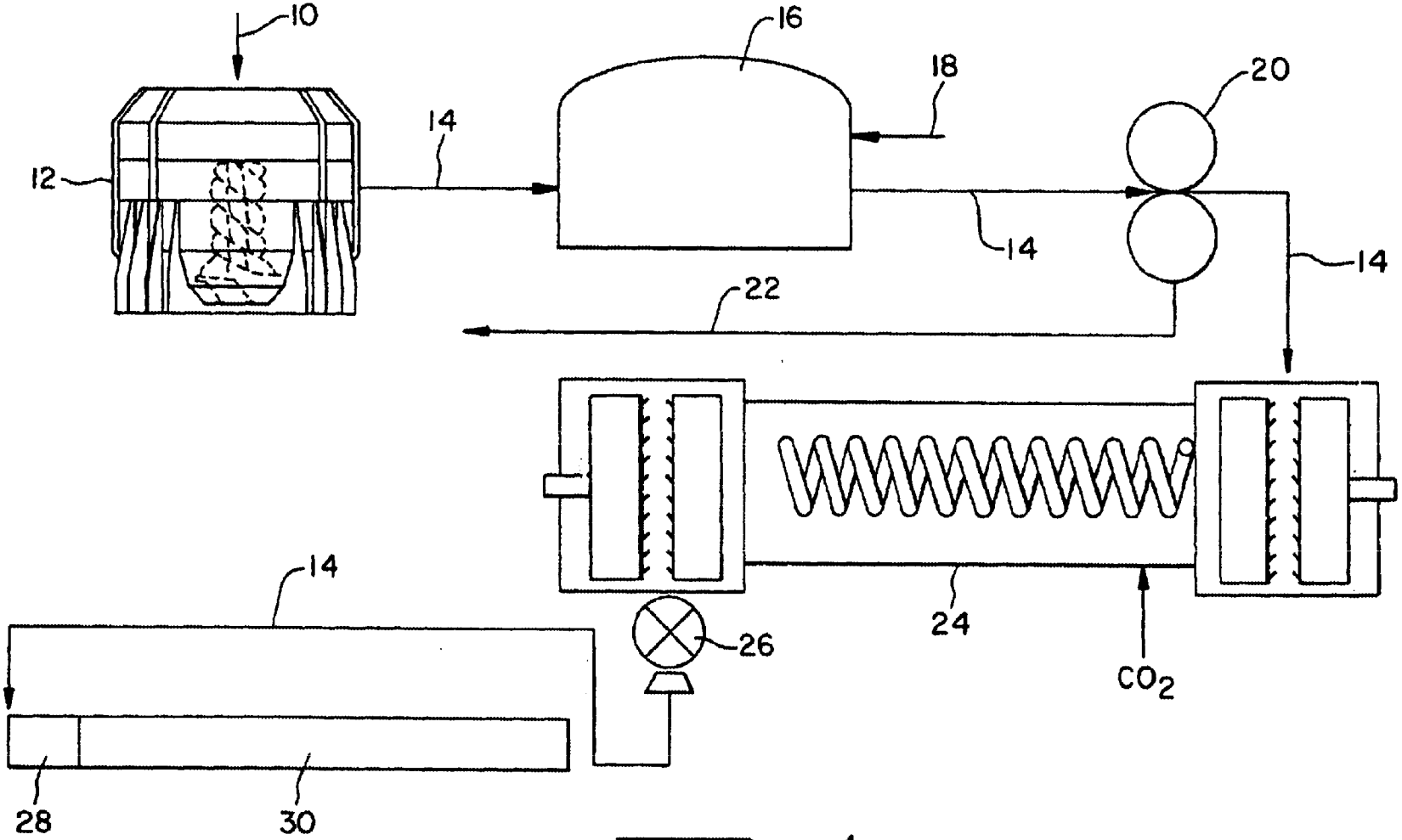
FIG. 1 is a simplified process diagram for the possible treatment of pulp material, which is subsequently to be used for the formation of one each external ply of the corresponding pulp material web.

Referring now to the drawings, and more particularly to FIG. 1 there is shown a simplified process diagram for the treatment of pulp material, which is subsequently used in order to form at least one of the two external plies of a multi-ply fiber material web. The fiber material web can in particular be a paper or cardboard web. In this process, at least one additive, preferably a filler, is at least partially deposited on the wetted fiber surfaces of the corresponding pulp material. In the present embodiment, an additive or filler of calcium carbonate is deposited, in particular precipitated calcium carbonate. In this process, a filler is deposited on the external surfaces of the hollow fibers, into the wetted interior hollow spaces (lumen), and in the walls of the hollow fibers.

Figure 2:
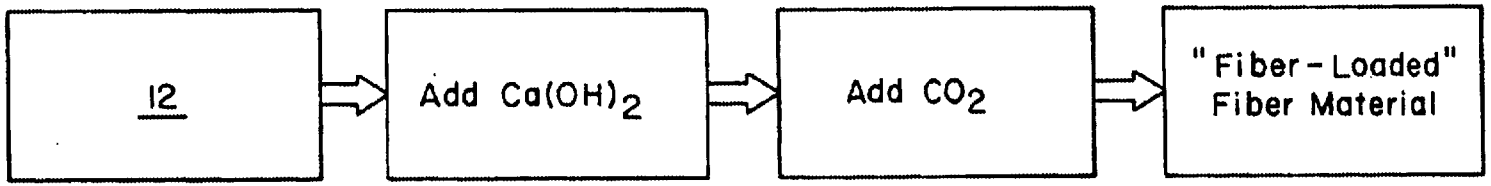
FIG. 2 is a simplified view of the chemical reaction that is initiated when treating pulp material.

According to FIG. 1, available pulp raw material 10 is prepared into pulp material 14 in pulper 12, in which the fibers are, separated from each other. Pulp material 14 contains at least partly water which can be present between the fibers and in the hollow spaces (lumen) and in the walls of the hollow fibers. Pulp material 14 can be provisioned in the form of so-called "dewatered crump pulp" (see also document U.S. Pat. No. 5,223,090), which means that while water is stored in the hollow fibers of pulp material 14, no free water is contained in pulp material 14. Furthermore, in regard to pulp material 14 pulp that has been dissolved in pulper 12, or dissolved waste paper with additives, or "never dried pulp" can be used. Pulp material 14 is subsequently fed into collecting container 16, in which substance 18, containing calcium oxide and/or calcium hydroxide (slaked lime), is added in such a way that at least part of it associates with the water that is present in the pulp material, i.e., between the fibers, inside the hollow fibers and in their walls. In this process the following chemical reaction occurs (see also FIG. 2):

$$CaH + H_2O \Longrightarrow Ca(OH)_2$$

Slaking of caustic lime — slaked lime

Molecular weight: 56 + 18 $\Longrightarrow$ 74

Subsequent to press 20, pulp material 14 is transported to a "fiber loading" reactor 24. In reactor 24, pulp material 14 is loaded with carbon dioxide ($CO_2$) in such a way that calcium carbonate ($CaCO_3$) is deposited on the wetted surfaces of the fibers. In this process the following chemical reaction occurs:

$$\text{"Fiber loading": } Ca(OH)_2 + CO_2 \Longrightarrow CaCO_3 + H_2O$$

(calcium carbonate + water)

Molecular weight: 74 + 44 $\Longrightarrow$ 100 + 18

Accordingly, for example 560 kg CaO and 440 kg $CO_2$ make one ton of calcium carbonate in the process.

The appropriately treated pulp material 14 can then be transferred via valve 26 (which can be a rotating valve) to the material suspension feed, corresponding to an external ply, headbox 28 of paper machine 30.

Substance 18 containing calcium oxide and/or calcium hydroxide can be added in collecting container 16 at a rate of approx. 0.1% up to approx. 50.0% by weight with respect to the dry weight of the corresponding pulp material.

Reactor 24 includes a closed container, which is pressurized with the appropriate carbon dioxide gas. Furthermore, pulp material 14 can be subjected to a mixing procedure within reactor 24, during which it is exposed to a high shearing effect. The loading with carbon dioxide is then performed during the mixing procedure. This mixing procedure can be performed by means of a shearing effect, which is at least so high that an energy input of no less than approx. 10 W-hr to approx. 50 W-hr per kg of fiber results, based on dry weight.

Figure 3:
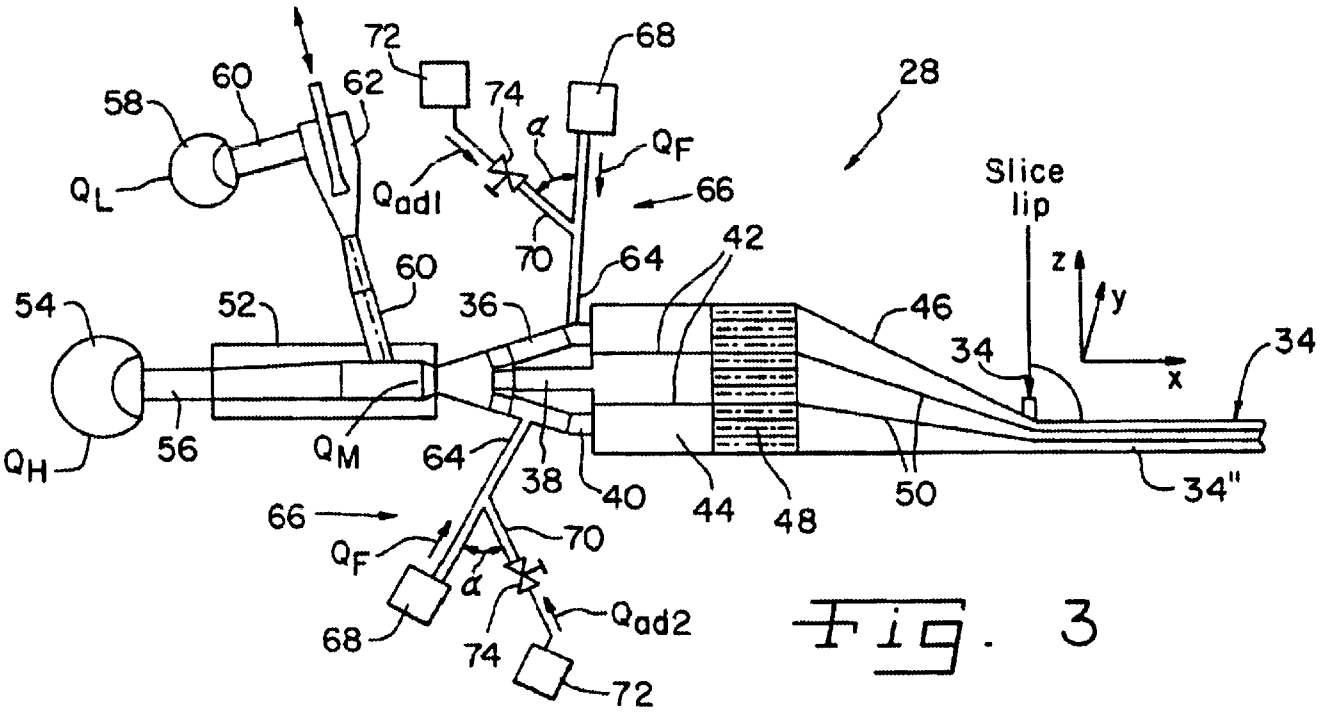
FIG. 3 is a schematic view of an embodiment of a headbox of the corresponding paper machine.

Now further referring to FIG. 3, headbox 28 of paper machine 30 is shown sectioned in the direction of the z-axis, i.e., in the direction of the thickness of fiber material web 34 is to be formed. In each of the sections, extending in a transverse y-axis direction, three superimposed material suspension feeds 36, 38 and 40 are provisioned so that each feeds into a corresponding section of chamber 44 of headbox 28, with chamber 44 being subdivided by lamellae 42. Between chamber 44, which is also correspondingly subdivided in the transverse direction of the y-axis, and nozzle 46, headbox 28 features turbulence generator 48. Lamellae 42 extends into turbulence generator 48 so that it too is sectioned correspondingly. Also, the interior space of nozzle 46 may be sectioned accordingly, for which purpose, lamellae 50 can be utilized. The result is a multi-layer headbox for the formation of a multi-ply fiber web, or as is shown in FIG. 3, a three-ply fiber material web 34.

To each of the sections, extending in the transverse y-axis direction, a sectional mixer 52 is assigned, in which a partial suspension flow $Q_H$ is admixed to a partial suspension flow $Q_L$. These two partial suspension flows may have different consistencies, for example. Suspension flow $Q_H$ that is fed into headbox 28 via transverse distribution line 54, is fed into various sectional mixers 52 via branching line 56. Suspension flow $Q_L$ that is fed into headbox 28 via transverse distribution line 58, is fed into various sectional mixers 52 via branching lines 60, and corresponding proportioning devices 62. Proportioning devices 62 include appropriate valves.

The combined flow $Q_M$ that is produced by each sectional mixer 52 is distributed to three material suspension feeds 36, 38 and 40 of each section.

Pulp material, preferably a filler, which is deposited via feeding line 64 of proportioning device 66, is fed to each of material suspension feeds 36 and 40, and feeds into each of the two external material suspension feeds 36 and 40 that serve the formation of the upper and the lower ply 34', 34", respectively, of pulp web 34. The corresponding pulp material can be fed via distribution line 68 that extends in a transverse direction and from which various lines 64 branch off corresponding to the sections of headbox 28.

Feeding lines 70 feed into various feeding lines 64 at an angle $\alpha$, via which an additional additive, preferably diluting water or strainer water can be admixed to the pulp material that is preferably loaded with filler. In this process, this additive can be fed via transverse distribution lines 72, from which feeding lines 70, that correspond to the individual sectors, branch off.

In each of feed lines 70, one valve 74 each is provisioned.

Angle $\alpha$ should be selected so that the combined flow, which is fed via each proportioning device 66 of material suspension feeds 36 and 40, remains constant regardless of the ratio at which the diluting water is added.

Branching lines 60 may enter into sectional mixer 52 at such an angle that the combined flow $Q_M$ that results at the outlet of mixer 52, remains constant regardless of the ratio at which partial suspension flows $Q_H$ and $Q_L$ are fed into headbox 28. Valves may be provisioned between transverse line 54 and sectional mixers 52, with combined flow $Q_M$ remaining constant independent from the ratio at which partial suspension flows $Q_H$ and $Q_L$ are being fed into headbox 28. Valves can also be provisioned between transverse line 54 and sectional mixers 52, in which case the combined flow $Q_M$, should the ratio between partial suspension flows $Q_H$ and $Q_L$ change, would still be kept constant through appropriate actuation of these valves and of valves 62.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for the formation of a multi-layer fiber web, comprising the steps of:

providing a source of pulp material including wetted fibers, said wetted fibers including a surface;

depositing at least partially calcium carbonate on said surface of said wetted fibers by way of a chemical reaction of carbon dioxide and at least one of calcium oxide and calcium hydroxide in a closed container, said carbon dioxide being loaded into said closed container under pressure, said at least one of calcium oxide and calcium hydroxide having been added to the water that is a part of said pulp material, said carbon dioxide being supplied to consummate the chemical reaction, thereby defining a modified pulp material;

producing at least two fiber web layers, at least one fiber web layer of said at least two fiber web layers being made from said modified pulp material, the remaining fiber web layers being produced from said pulp material; and forming said multi-layer fiber web from said at least one fiber web layer such that said at least one fiber web layer is made from said modified pulp material.

2. The process of claim 1, wherein said depositing step includes depositing said calcium carbonate on said surface of said wetted fibers.

3. The process of claim 1, wherein said wetted fibers include walls and a hollow interior, said depositing step including depositing said calcium carbonate into said hollow interior and onto said walls of said wetted fibers.

4. The process of claim 1, wherein at least one of said at least one fiber web layer is an exterior layer of said multi-layer fiber web.

5. The process of claim 1, wherein said depositing step includes depositing at least partially at least one additive including at least one filler onto said wetted fibers.

6. The process of claim 5, wherein said producing step includes producing at least one intermediate layer and at least one exterior layer, said at least one exterior layer having a higher content of an additive than said at least one intermediate layer.

7. The process of claim 5, wherein said depositing step includes depositing calcium carbonate on said surface of said wetted fibers as an additive.

8. The process of claim 5, wherein said depositing step includes depositing precipitated calcium carbonate on said surface of said wetted fibers as an additive.

9. The process of claim 1, wherein said at least one of calcium oxide and calcium hydroxide is added to said pulp material from 0.1% to 50.0% by weight with respect to a dry weight of said pulp material.

10. The process of claim 1, further comprising the step of mixing said pulp material with carbon dioxide, said mixing step having a high shearing effect on said pulp material.

11. The process of claim 10, wherein said mixing step is accomplished with from 10 to 50 W-hr per kg of a dry mass of said pulp material.

12. The process of claim 1, wherein said producing step includes producing only one of said at least one fiber web layer from modified pulp material.

13. The process of claim 1, wherein said pulp material is at least one of wood pulp dissolved in a pulper and waste paper with additives.

14. The process of claim 1, wherein said pulp material is "never dried pulp".

* * * * *

UNITED STATES PATENT AND TRADEMARK OFFICE

CERTIFICATE OF CORRECTION

PATENT NO. : 6,627,042 B2
DATED : September 30, 2003
INVENTOR(S) : Holik

It is certified that error appears in the above-identified patent and that said Letters Patent is hereby corrected as shown below:

Column 5,
Line 1, please delete "CaH", and substitute therefore, -- CaO --.

Signed and Sealed this

Sixth Day of July, 2004

JON W. DUDAS
*Acting Director of the United States Patent and Trademark Office*